US006979231B2

(12) United States Patent
Shinohara

(10) Patent No.: US 6,979,231 B2
(45) Date of Patent: Dec. 27, 2005

(54) SWITCH-EQUIPPED INPUT-OUTPUT PLUG

(75) Inventor: Ikuo Shinohara, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/916,471

(22) Filed: Aug. 12, 2004

(65) Prior Publication Data

US 2005/0064764 A1 Mar. 24, 2005

(30) Foreign Application Priority Data

Aug. 18, 2003 (JP) ..... 2003-294580

(51) Int. Cl.[7] ..... H01R 24/04
(52) U.S. Cl. ..... 439/669; 439/188
(58) Field of Search ..... 439/669

(56) References Cited

U.S. PATENT DOCUMENTS 6,080,021 A * 6/2000 Weingartner ..... 439/669
6,109,797 A * 8/2000 Nagura et al. ..... 385/88
6,595,804 B2 * 7/2003 Nagata ..... 439/668

* cited by examiner

*Primary Examiner*—Briggitte R. Hammond
(74) *Attorney, Agent, or Firm*—Oblon, Spivak, McClelland, Maier & Neustadt, P.C.

(57) ABSTRACT

A switch-equipped input-output plug available for a voice input-output connector (jack) different from one type of portable phone or the like from another is provided. A connecting portion of a 4-electrode plug, for connecting a manipulate-signal electrode has a screwing portion formed therearound. is used for two types of portable phones respectively equipped with 4-electrode and 3 electrode jacks. Thus, a single type of plug is commonly available for two types of portable phones respectively equipped with 4-electrode and 3 electrode jacks by using an adaptor designed to serve as the manipulate-signal electrode such that the adaptor is screwed with the connecting portion and is detached from the connecting portion, respectively.

5 Claims, 8 Drawing Sheets

SWITCH-EQUIPPED INPUT-OUTPUT PLUG

BACKGROUND OF THE INVENTION

1. Field of the Invention

The present invention relates to a switch-equipped input-output plug, and in particular, it relates to an improvement of a switch-equipped 3-electrode/4-electrode shared input-output plug.

2. Description of the Related Art

Hitherto, a switch-equipped earphone microphone of a portable phone has an input-output terminal different one carrier from another or one type of portable phone from another. The input-output terminals are generally classified into a 3-electrode jack type having a diameter of 2.5 mm and being available for a 3-electrode plug; and a 4-electrode jack type formed by adding a fourth terminal to the outer surface of the 3-electrode jack type.

The above-described 3-electrode and 4-electrode plugs are disclosed in detail in Japanese Registered Utility Model No. 3036532 (see FIGS. 1 to 4, hereinafter, referred to as Patent Document 1). When such a known 3- or 4-electrode plug is used for a voice input-output apparatus (for example, a switch-equipped earphone microphone), an input-output operation of voice of a voice output apparatus (earphone microphone) or a voice input apparatus (earphone or head phone) is controlled in accordance with an on/off operation of a switch by using a switch circuit.

Unfortunately, the known switch-equipped earphone microphone is required to use a 3-electrode or 4-electrode plug depending on the type of an input-output terminal of an electronic device installed in a portable phone or the like (in other words, depending on the type of a portable phone or the like); hence a single type of a switch-equipped earphone microphone is not commonly available for portable phones or the like made by different manufacturers.

In order to solve the above-described problem, Patent Document 1 discloses a switch-equipped 3-electrode/4-electrode shared input-output plug available for a switch-equipped earphone microphone even when the type of an input-output terminal of an electronic device installed in a portable phone or the like is different one portable phone from another.

FIG. 5A is a side view a 3-electrode/4-electrode shared plug 10 disclosed in Patent Document 1, and FIG. 5B is a partial side sectional view of the 3-electrode/4-electrode shared plug 10.

As shown in FIGS. 5A and 5B, the 3-electrode/4-electrode shared plug 10 includes (i) a column-shaped pin portion 6 integrally formed by synthetic resin insulators 5 serving as forming members and insulating one of three electrodes of a microphone electrode (input electrode) 1, an earphone or loudspeaker electrode (output electrode) 2, and a ground electrode 3 from the remaining ones; (ii) a base portion 7 having the pin portion 6 fixed to one end thereof; (iii) a grooved portion 8 disposed at the one end of the base portion 7, and having a greater diameter than that of the pin portion 6; (iv) terminals 9 formed in the grooved portion 8; (v) four lines a to d disposed in the base portion 7, respectively connected or bonded, in the base portion 7, to the three electrodes 1 to 3, and to one of the terminals 9, extending outside the base portion 7 from the other end of the base portion 7; and (vi) and an adaptor 4 (see FIG. 6). The grooved portion 8 is formed so as to be fitted into or screwed with the adaptor 4, and the terminals 9 are formed so as to be connected with the adaptor 4 at the bottom or the side of the inside of the grooved portion 8. A cord 12 has the four lines a, b, c, and d included therein, extending outside from the other end of the base portion 7.

Meanwhile, in the plug 10 shown in FIGS. 5A and 5B, since the adaptor 4 serving as a fourth electrode is not fitted into or screwed with the grooved portion 8, the voltage of the line d connected to one of the terminals 9 is zero. Accordingly, the plug 10 serves as a 3-electrode plug in which the three electrodes of the microphone electrode 1, the earphone or loudspeaker electrode 2, and the ground electrode 3 function.

FIGS. 6A and 6B illustrate an example structure of the adaptor 4 serving as the fourth electrode.

As shown in FIGS. 6A and 6B, the adaptor 4 has a space (or through-hole) 43 similar to the normal cross-section of the pin portion 6, formed therein so as to have the pin portion 6 of the 3-electrode/4-electrode shared plug 10 loosely fitted thereinto. Since the normal cross-section of the pin portion 6 shown in FIGS. 6A and 6B has a round shape, the normal cross-section of the space (or the through) 43 shown in FIGS. 6A and 6B has a round shape accordingly.

When the adaptor 4 is formed so as to be fitted into the grooved portion 8 as shown in FIG. 6A, the outer shape (normal cross-section) of the adaptor 4 is not limited to a specific one, and it may be a round or a polygon. When the adaptor 4 is formed so as to have a thread groove 45 formed therearound and to be screwed into the grooved portion 8 as shown in FIG. 2B, its the outer shape (normal cross-section) is a round (that is, in this case, the adaptor 4 has a ring shape).

Grooves 41 and 42 shown in FIG. 6A, formed in the adaptor 4, are detent grooves preventing the adaptor 4 from moving back when the adaptor 4 is fitted into the grooved portion 8.

Meanwhile, the adaptor 4 shown in FIGS. 6A and 6B is processed so as to have an electrically insulated inside, for example, by bonding a synthetic resin onto the inside by pressing, or a portion of the adaptor 4 of the pin portion 6, coming contact with the grooved portion 8 when the adaptor 4 is fitted into or screwed with the grooved portion 8, is subjected to an insulating process.

FIG. 7 is a side view of the plug 10 in a state in which the adaptor 4 shown in FIGS. 6A and 6B is fitted into or screwed with the grooved portion 8 shown in FIGS. 5A and 5B. The adaptor 4 is inserted from the top of the pin portion 6 toward the base portion 7 and fitted into or screwed with the grooved portion 8. In this case, since the top or the side of the adaptor 4 comes into contact with and is connected with the terminals 9 disposed at the bottom or the side of the grooved portion 8, the adaptor 4 is connected with the line d through one of the terminals 9 and serves as a manipulate-signal electrode. Accordingly, the plug 10 serves as a 4-electrode plug in which four electrodes of the microphone electrode 1, the earphone or loudspeaker electrode 2, the ground electrode 3, and the manipulate-signal electrode (adaptor) 4 function.

FIG. 8 is a diagram of a switch circuit 100 of a switch-equipped voice input-output device (for example, a switch-equipped earphone microphone) including the above-described 3-electrode/4-electrode shared plug 10.

As shown in FIG. 8, the switch circuit 100 is made up by the line a connected with the microphone electrode 1 at one end thereof and with a first terminal of a microphone 101 at the other end thereof; the line b connected with the earphone electrode 2 at one end thereof and with a first terminal of an earphone 102; the line c connected with the ground electrode 3 at one end thereof and having a contact 103B of a switch unit 103 at the other end thereof, and connecting a line a' extending from a second terminal of the microphone 101 and a line b' extending from a second terminal of the earphone 102 with each other; the line d connected with the manipulate-signal electrode 4 at one end thereof and having a contact 103A of the switch unit 103; and a blocking diode 104 disposed between the lines b and d, connected with the ground electrode 3 at one end thereof, with a current direction from the line b to the line d as a forward direction.

With above structure, in the 3-electrode/4-electrode shared plug 10, when the adaptor 4 is not fitted into or screwed with the grooved portion 8, and when the 3-electrode/ 4-electrode shared plug 10 is inserted into a normal recessed connector (jack) of a portable phone or the like, the voltage of the line d becomes zero; hence the switch unit 103 performs an on/off operation between the lines b and c and thus can perform a reception/transmission operation in accordance with the on/off operation, whereby the switch circuit 100 serves a switch circuit of a 3-electrode plug.

Also, in the 3-electrode/4-electrode shared plug 10 has a structure, when the adaptor 4 is moved toward the base portion of the pin portion 6 and is fitted into or screwed with the grooved portion 8 so as to serve as a manipulate-signal electrode, and when the pin portion 6 is inserted into a connecting hole of a RC connector of an electronic device installed in a portable phone or the like until the upper part of the RC connector comes into contact with the adaptor 4, since the voltage of the line d becomes higher than that of the line b, and the switch unit 103 performs on/off operation between the lines d and c and hence can perform a reception/transmission operation in accordance with the on/off operation, whereby the switch circuit 100 serves as switch circuit of a 4-electrode plug.

Although the switch-equipped 3-electrode/4-electrode shared plug having the foregoing known structure is available for any one of two type of portable phones; one having 3-electrode jack and the other having a 4-electrode jack, since adaptor 4 serving as a manipulate-signal electrode is fitted into or screwed with the grooved portion 8 formed by machining the base portion 7, through which the cord 12 making up a 3-electrode plug extends outside, it is difficult to fit the grooved portion 8 into the adaptor 4 because of a thin wall of the adaptor 4, as a result, the pin portion 6 is likely detached from the base portion 7.

Also, in some portable phones, since a jack fixed to a casing lies on a part of a chassis lying deep inside the casing, and also, a gap exists between the casing and the chassis, the pin portion 6 of a 3-electrode plug, having a standard length, cannot be inserted into the jack to its full length so that the root thereof comes into contact with the jack, thereby sometimes causing poor contact.

SUMMARY OF THE INVENTION

Accordingly, it is an object of the present invention to provide a switch-equipped input-output plug free from the above problems, that is, it is an object to provide a 3-electrode/ 4-electrode shared, switch-equipped input-output plug having a structure in which a ring-shaped adaptor is designed to serve as a manipulate-signal electrode of a 4-electrode plug, a screwing portion is formed around a connecting portion for connecting the manipulate signal electrode, and the adaptor thus is screwed with the screwing portion.

In order to solve the above problems and achieve the above objects, the present invention has been made. A switch-equipped input-output plug serving as a 4-electrode plug in accordance with a first aspect of the present invention includes (i) an adaptor designed to serve as a manipulate-signal electrode; and (ii) an electrode portion integrally formed by a voice-input electrode; a voice-output electrode; a ground electrode; and a connecting portion for connecting the manipulate signal electrode, having a greater diameter than that of a pin portion made up by the voice-input electrode; the voice-output electrode, and the ground electrode, any one of these four electrodes being insulated from the remaining ones. The connecting portion has a screwing portion formed therearound, and the adaptor designed to serve as the manipulate-signal electrode engages with the screwing portion.

Also, a switch-equipped input-output plug in accordance with a second aspect of the present invention includes (i) a pin portion integrally formed by a voice-input electrode; a voice-output electrode; and a ground electrode, any one of these three electrodes being insulated from the remaining ones; (ii) a connecting portion for connecting a manipulate-signal electrode, having a screwing portion having a greater diameter than that of the pin portion, the end of the pin portion and the connecting portion being insulated with an insulator; (iii) a base portion having the connecting portion fixed thereto; (iv) three lines disposed in the base portion, connected with the respective three electrodes at one end of the base portion in the base portion, and extending outside the base portion from the other end of the base portion; and (v) a single line disposed in the base portion, connected with the connecting portion at one end of the base portion, and extending outside the base portion from the other end of the base portion.

BRIEF DESCRIPTION OF THE DRAWINGS

FIG. 1 illustrates a switch-equipped input-output plug, serving as a 3-electrode plug, according to the present invention, wherein

DESCRIPTION OF THE PREFERRED EMBODIMENTS

Figure 1A:
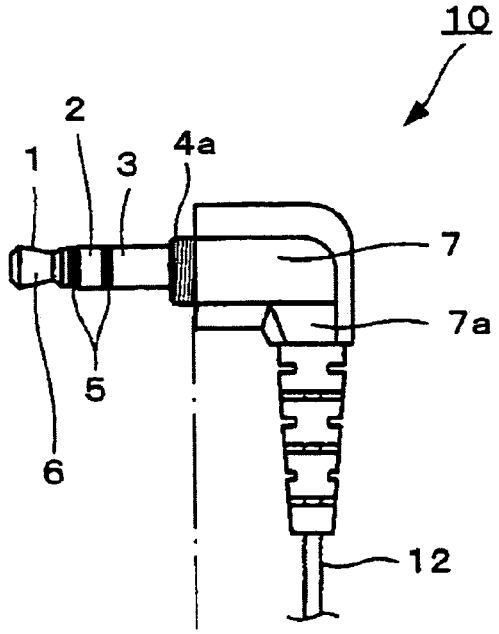
FIG. 1A is a side view of the plug.
Figure 2:
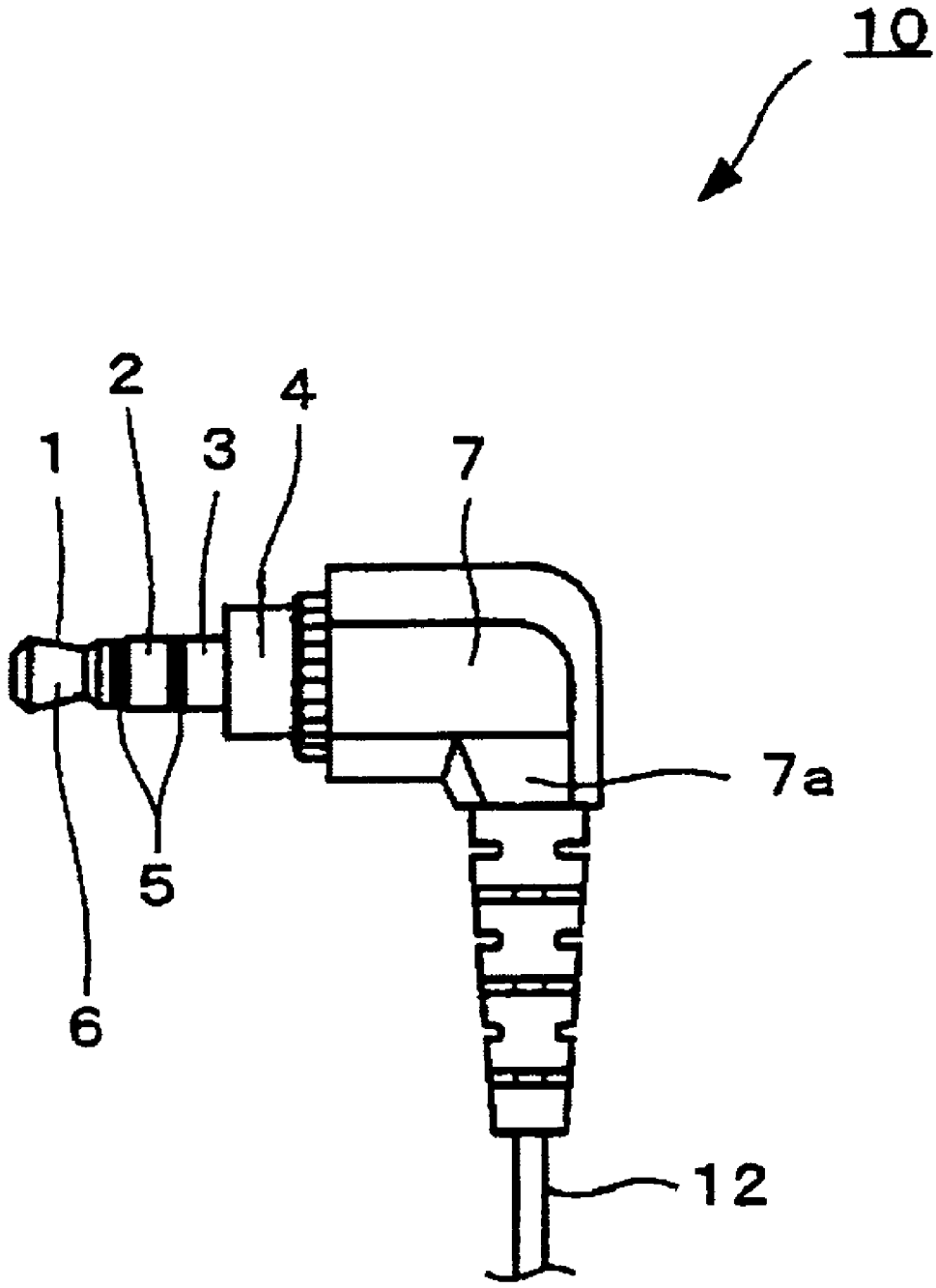
FIG. 2 is a side view of a switch-equipped input-output plug serving as a 4-electrode plug, according to the present invention.
Figure 3:
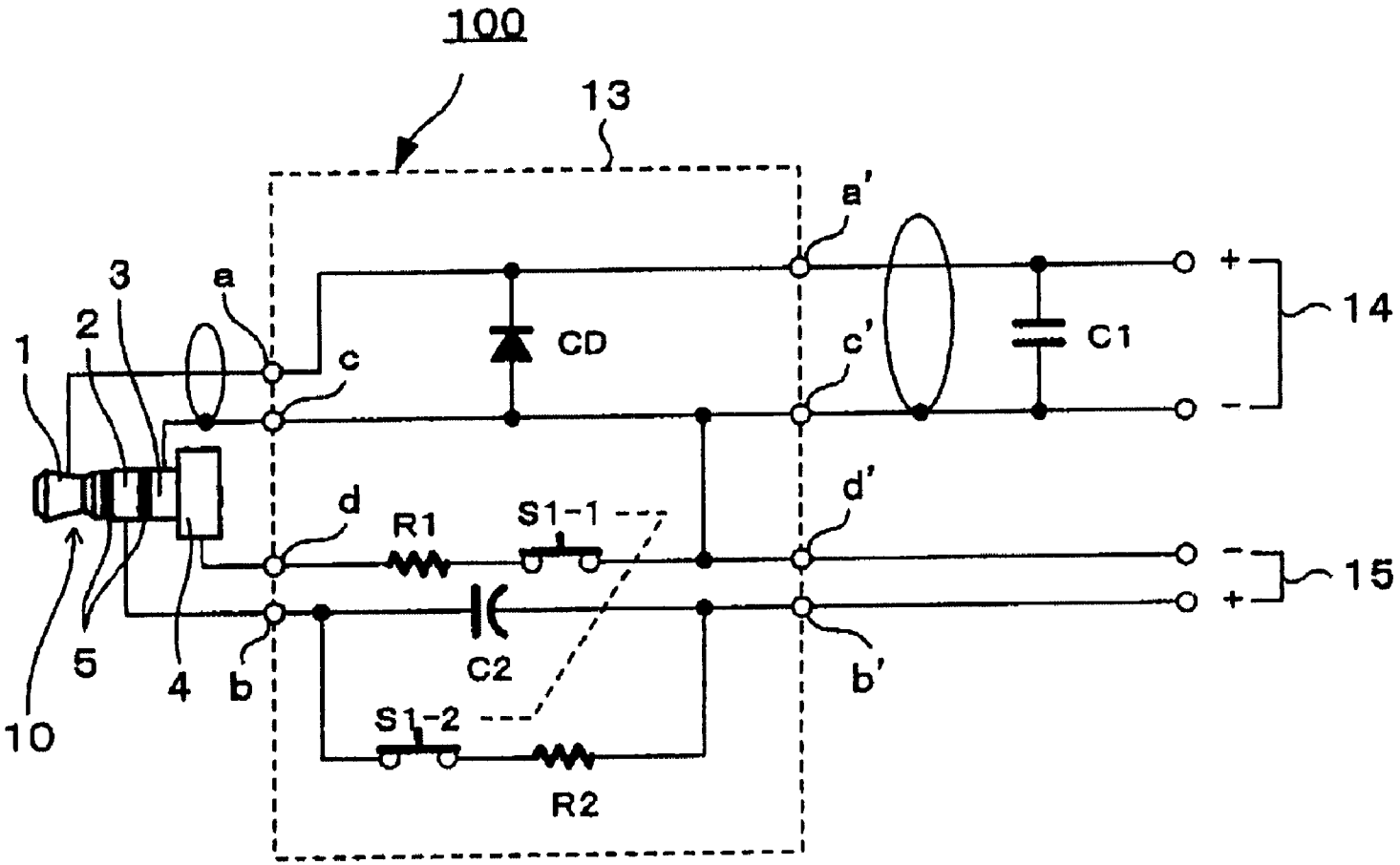
FIG. 3 is a circuit diagram of a switch unit of the switch-equipped input-output plug according to the present invention.

As a switch-equipped plug according to the present invention, a 3-electrode/4-electrode shared plug will be described. FIG. 1A is a side view of a 3-electrode/4-electrode shared plug when used as a 3-electrode plug, according to the present invention, FIG. 2 is a side view of a 3-electrode/4-electrode shared plug when used as a 4-electrode plug, according to the present invention, FIG. 3 is a circuit diagram of the 3-electrode/4-electrode shared plug according the present invention, FIG. 4 is a perspective view of a switch-equipped earphone microphone of a portable phone, to which the present invention is applied.

Before describing the 3-electrode/4-electrode shared plug according to the present invention, the overall structure of a switch-equipped earphone microphone 22, to which the 3-electrode/4-electrode shared plug is applied, will be described with reference to FIG. 4.

Figure 4:
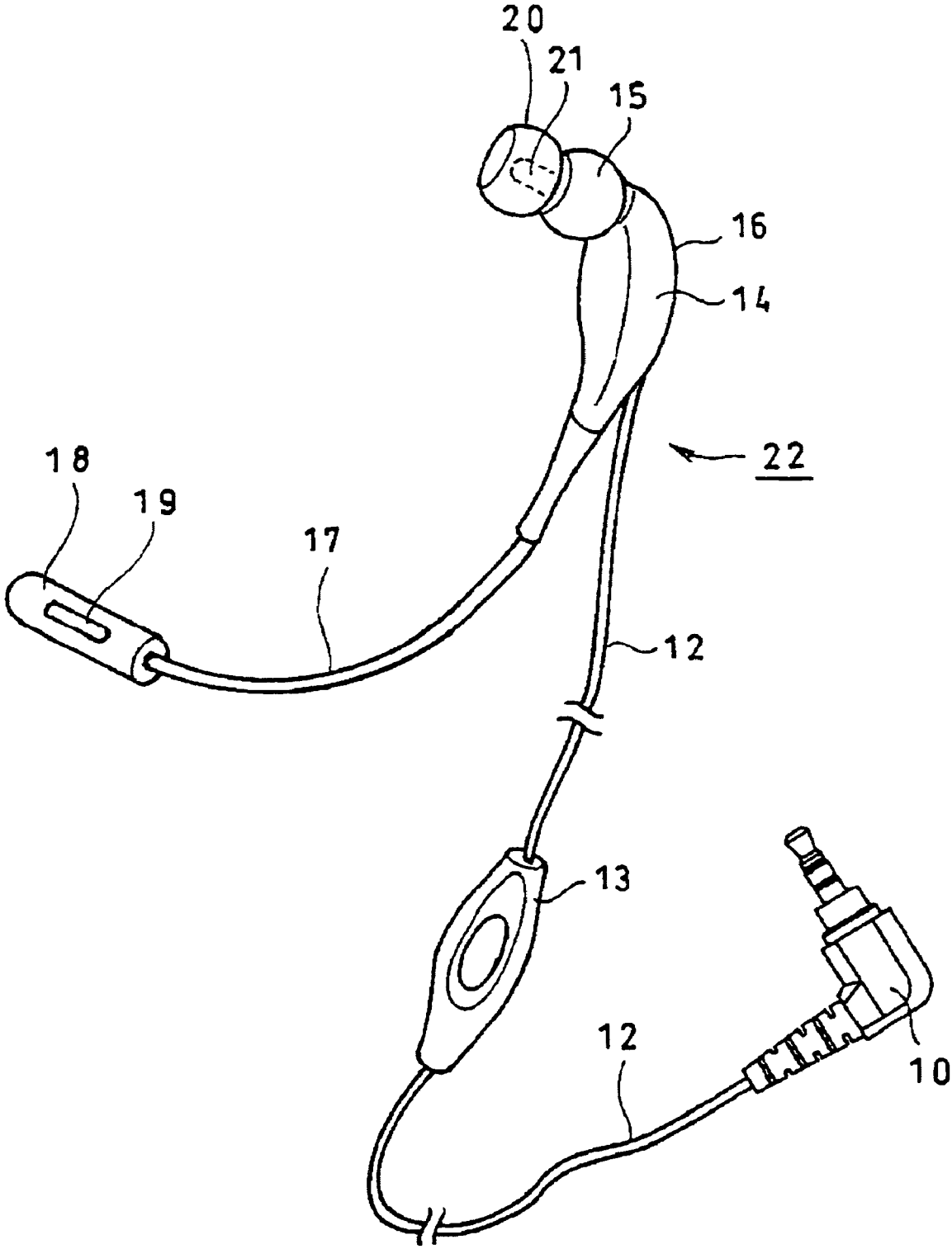
FIG. 4 is a perspective view of an earphone microphone including the input-output plug according to the present invention.

As shown in FIG. 4, a 3-electrode/4-electrode shared plug 10 according to the present invention is connected to one end of a cord 12. The cord 12 has a switch box 13 having built-in switches S1-1 and S1-2 (see FIG. 3) connected to the middle part thereof and an earphone microphone 14 connected to the other end thereof.

The earphone microphone 14 made up by (i) a synthetic resin casing 16 including a built-in microphone (not shown); and (ii) an insertion earphone 15 having an insert portion 21 to be inserted into an external acoustic meatus or the like, disposed at one end of the casing 16; and (iii) a conduit tube 17 composed of flexible rubber or the like, disposed at the other end of the casing 16. The conduit tube 17 has a synthetic-resin made voice-introducing portion 18 fixed to the top thereof. The voice-introducing portion 18 has a voice intake hole 19 formed therein. The insert portion 21 is fitted into a dome-shaped rubber cover 20.

The 3-electrode/4-electrode shared plug 10 of the switch-equipped earphone microphone 22 having the above-described structure is inserted into a connector slot of a 3-electrode or 4-electrode jack of a portable phone, and the earphone 15 is inserted into, for example, an opening of an external acoustic meatus of an operator. The flexible conduit tube 17 can be brought close to the mouth of the operator for conversation during a transmitting/receiving operation.

Referring to FIGS. 1 to 3, an example of the 3-electrode/4-electrode shared plug having the above described structure according to the present invention will be described in detail in the cases where the plug is attached to or detached from each of portable phones respectively having a 3-electrode jack and a 4-electrode jack disposed therein. Meanwhile, like parts in FIGS. 5 to 8 are identified by the same reference numbers as in the figures.

Figure 1B:
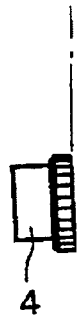
FIG. 1B is a side view of an adaptor of the plug.

FIGS. 1A and 1B are side views of the 3-electrode plug 10 and an adaptor designed to serve as a manipulate-signal electrode, respectively. In the 3-electrode plug 10, one of any one of four electrodes of a microphone electrode 1, an earphone electrode 2, a ground electrode 3, and a connecting portion 4*a* for connecting the manipulate signal electrode is insulated from the remaining ones by the corresponding one of insulators 5.

Figure 1C:
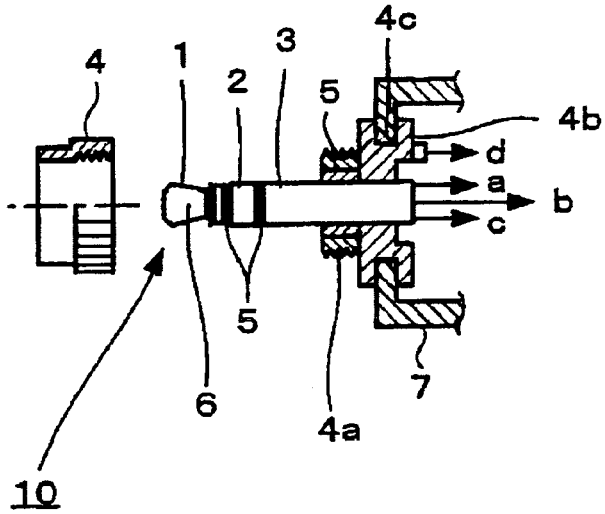
FIG. 1C is a magnified sectional view of a part of the plug, including a pin portion.

A pin portion 6 is made up by the microphone electrode 1, the insulator 5, the earphone electrode 2, the insulator 5, and the ground electrode 3 in that order, and has a diameter of about 2.5 mm. The connecting portion 4*a* has a diameter equal to 4.5 mm or smaller and is designed so as to have a thickness of 2.5 mm or greater. As shown in FIG. 1C, a magnified sectional view of a part of the plug 10 shown in FIG. 1A, the connecting portion 4*a* is disposed on a disc-shaped metal base 4*b* in a standing manner, and an approximately cylindrical base portion 7 composed of synthetic resin or the like and designed to serve as a casing is fitted into a groove 4*c* of the metal base 4*b* so as to be integrated with the metal base 4*b*.

Figure 5A:
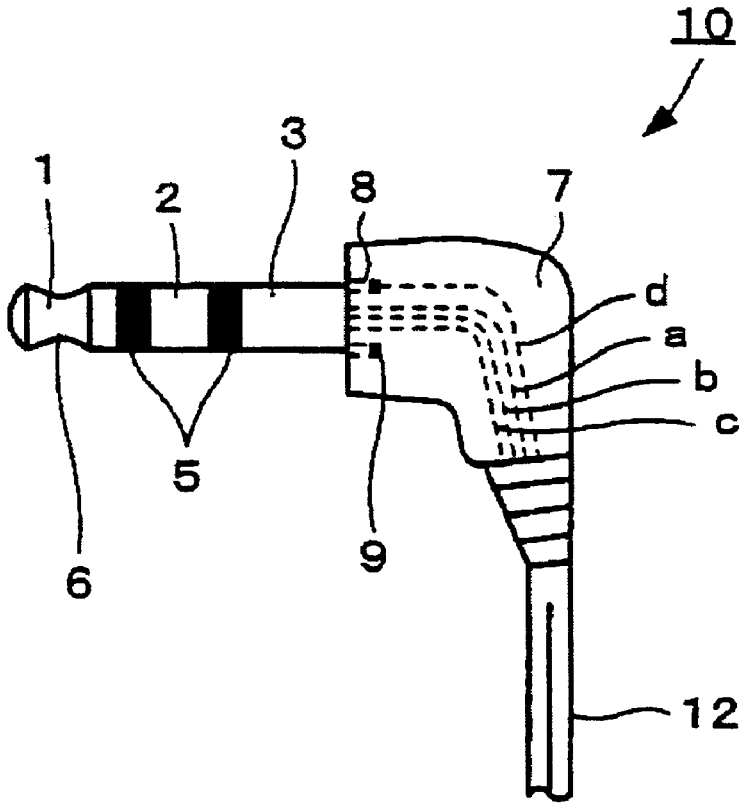
FIG. 5 is a side view of a known 3-electrode plug.
Figure 5B:
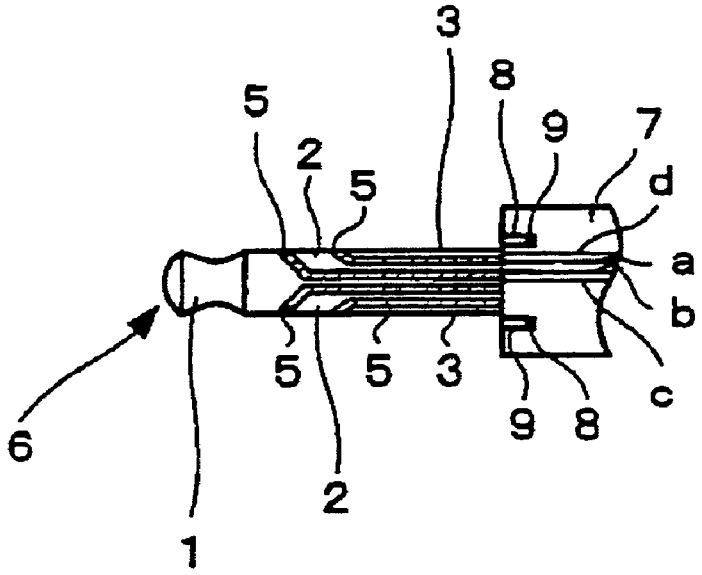
Figure 6A:
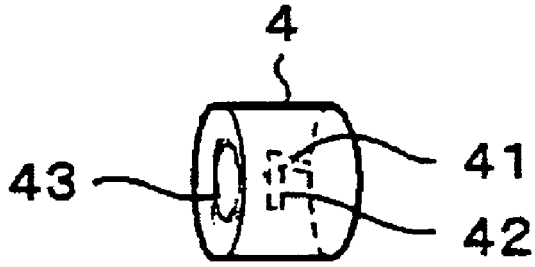
FIG. 6 is a perspective view of the structure of a known manipulate-signal electrode.
Figure 6B:
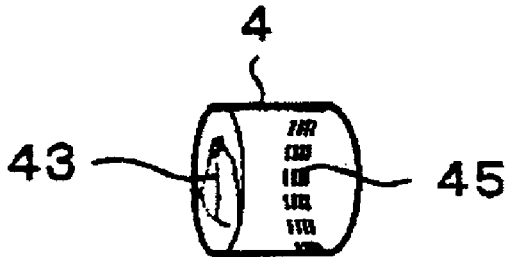
Figure 7:
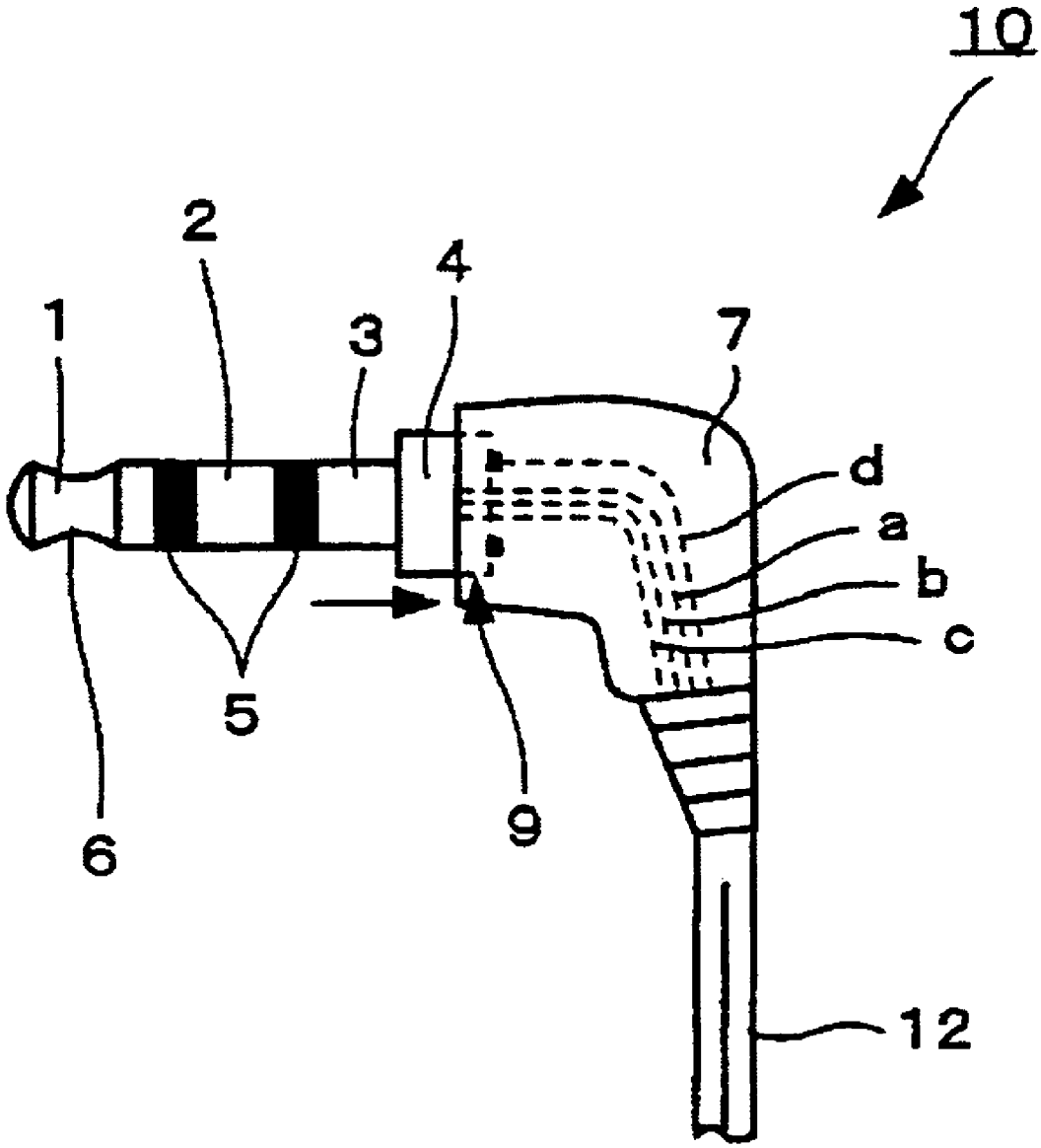
FIG. 7 is a side view of a known 4-electrode plug.
Figure 8:
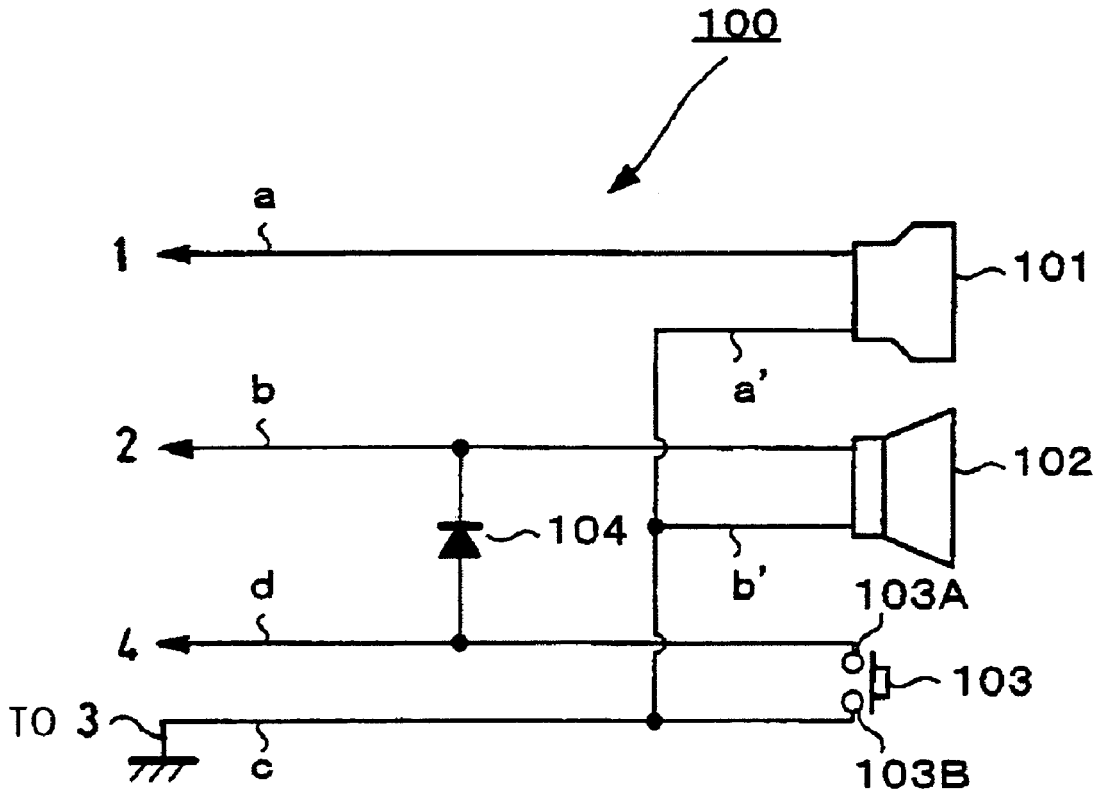
FIG. 8 is a circuit diagram of a known 3-electrode/4-electrode shared switch unit.

In the same fashion as described referring to FIGS. 5 and 7, the base portion 7 has four lead wires a to d formed therein, combined into a single component serving as the cord 12 while passing through respective electrode terminals. Also, the cord 12 is led outside through a cord-leading out portion 7*a*.

As shown in FIGS. 1B and 1C, an adaptor 4 designed to serve as a manipulate-signal electrode has a nut shape and an approximately cylindrical bore portion. The bore portion has a female screw formed on the internal surface thereof so as to screw with a male screw formed on the external surface of the connecting portion 4*a*. The adaptor 4 has two steps parts formed on the external surface thereof, one stepped part having a greater diameter of 6.5 mm and being subjected to knurling, and the other stepped part having a smaller diameter of 6 mm and also having a connecting portion for connecting the manipulate signal electrode formed thereon.

FIG. 2 is a side view of the 4-electrode plug 10 of the switch-equipped earphone microphone. The 4-electrode plug 10 includes the pin portion 6 integrally formed by the microphone electrode 1, the earphone electrode 2, the ground electrode 3, and the insulators 5 insulating any one of the foregoing three electrodes from the remaining ones; the base portion 7; the adaptor 4 designed to serve as a manipulate-signal electrode when firmly fixed to the base portion 7; and four lines a to d disposed in the base portion 7 connected with the electrodes 1 to 4 in the base portion 7 and extending to the external cord 12 from the other end of the base portion 7.

FIG. 2 illustrates a state of the plug 10 in which the adaptor 4 shown in FIG. 1B is fitted through the pin portion 6 as shown in FIG. 1C, and is screwed with the connecting portion 4*a* of the 3-electrode plug 10 shown in FIG. 1A, and the plug 10 is inserted into a voice input-output connector of a portable phone having a 4-electrode jack disposed therein.

FIG. 3 illustrates a switch circuit 100 of a switch-equipped earphone microphone including the 3-electrode/4-electrode shared plug according to the present invention. The switch circuit 100 includes input-terminals a to d and output terminals a' to d' disposed in the base portion 7, provided with first and second switches S-1 and S-2, and making up a switch box 13 indicated by a dotted line in the figure. The input and output terminals a and a' connected to the microphone electrode 1 and the input and output terminals c and c' connected to the ground electrode 3 have an over-voltage prevention diode CD, a capacitor C1, and the earphone microphone 14 connected therebetween in parallel.

The input terminal b and the output terminal b' connected to the earphone electrode 2 have (i) a capacitor C2 connected therebetween in series and (ii) a serial circuit of the second switch S1-2 and a resistor R2 connected therebetween in parallel to the capacitor C2. The input terminal d and the output terminal d' connected to the manipulate-signal electrode 4 have a serial circuit of the first the switch S1-1 and a resistor R1 connected therebetween. The first switch S1-1 and the output terminal d' have the ground electrode 3 connected therebetween. The output terminal b' and d' have the earphone 15 connected therebetween.

The first and second switches S1-1 and S1-2 are in conjunction with each other.

With the above structure, when the second switch S1-2 is turned on, the earphone 15 is driven by the closed circuit formed by the earphone electrode 2 and the ground electrode 3, and when the first switch S1-1 is turned on, a manipulate switching signal can be transmitted to or received from between the ground electrode 3 and the manipulate-signal electrode 4.

With the foregoing 3-electrode/4-electrode shared plug according to the present invention, when the adaptor 4 is removed from the connecting portion 4*a* as illustrated in FIG. 1A, and the plug is inserted into a slot having a 3

-electrode jack of a portable phone fixed thereto, the plug serves as a 3-electrode plug for a portable phone supporting a 3-electrode connector jack.

When the plug is used as 3-electrode plug as described above, even when a 3-electrode jack is fixed to chassis or the like of a portable phone, deep inside its casing, and a relatively large gap exists between the chassis and the casing, since the length of the pin portion 6 from the root to the top is extended by the height (about 2.5 mm) of the connecting portion 4*a*, each of the electrodes 1 to 3 reliably comes into contact with the 3-electrode jack, thereby preventing poor contact. Also, since a voice input-output connector hole (a 3-electrode plug slot for a 3-electrode jack) perforated in the casing of a portable phone is always sealed with a rubber cover for water proof, the connector hole has a greater diameter than the diameter (2.5 mm) of the pin portion 6, hence the slot for a 3-electrode jack disposed deep inside the casing must be found by trial and error. On the contrary, with the 3-electrode/4-electrode shared plug 10 according to the present invention, since the diameter of the connector hole is equal to the diameter (4.5 mm) of the connecting portion 4*a*, the plug 10 can be smoothly inserted into the slot of the 3-electrode jack disposed deep inside the casing while making the hole of the voice input-output connector guide the external surface of the connecting portion 4*a*.

In a 4-electrode portable phone, since the plug 10 is used by screwing the adaptor 4 together with the connecting portion 4*a* so as to be fixed to the same as shown in FIG. 2, the plug is available for a 4-electrode jack, and also, the adaptor 4 is fixed by screwing, thereby achieving a reliable 4-electrode plug which is unlikely to drop during use. In addition, since the electrodes can be easily can wiped with a sheet of soft cloth in a state in which the adaptor is removed and all electrodes are visible, practically satisfactory electrical continuity is maintained over a long period of use.

In the above-described example, although the connecting portion 4*a* has a continuous thread carved therearound, even when the thread is partially formed, the plug 10 can be constructed such that the adaptor 4 can be easily firmly screwed with the connecting portion, and is also unlikely loosened.

With the structure of the switch-equipped input-output plug according to the present invention, the threaded adaptor designed to serve as a manipulate-signal electrode is screwed with a screwing portion formed around the external surface of the connecting portion, and the adaptor is thus fixed by screwing, thereby achieving a highly reliable plug which is less likely to drop during use than that in the known plug in which the adapter is loosely fitted into a grooved portion.

Also, since the manipulate-signal electrode is formed so as to have a diameter of about 4.5 mm and a thickness of about 2.5 mm, even when an input-output terminal of a portable phone is disposed on a chassis lying deep inside of its casing, when the plug 10 is used as a 3-electrode plug, the pin portion can be inserted deep inside the casing.

In addition, since the manipulate-signal electrode serving as the adaptor is formed so as to be detachable from the pin portion, all four electrodes of the pin portion can be wiped with a sheet of soft cloth, whereby the contact part of each electrode can be kept clean for a long period time, whereby necessary electrical continuity of the plug can be maintained.

What is claimed is:

1. A switch-equipped input-output plug serving as a 4-electrode plug, comprising:

an adaptor designed to serve as a manipulate-signal electrode; and an electrode portion integrally formed by a voice-input electrode; a voice-output electrode; a ground electrode; and a connecting portion for connecting the manipulate signal electrode, having a greater diameter than that of a pin portion made up by the voice-input electrode; the voice-output electrode, and the ground electrode, any one of these four electrodes being insulated from the remaining ones, wherein the connecting portion has a screwing portion formed therearound, and the adaptor designed to serve as a manipulate-signal electrode engages with the screwing portion.

2. The switch-equipped input-output plug according to claim 1, wherein the manipulate-signal electrode can be screwed with the connecting portion, and wherein, when the manipulate-signal electrode is screwed with or is not screwed with the connecting portion, the plug serves a 4-electrode plug or a 3-electrode plug, respectively.

3. A switch-equipped input-output plug, comprising:

a pin portion integrally formed by a voice-input electrode; a voice-output electrode; and a ground electrode, any one of these three electrodes being insulated from the remaining ones;

a connecting portion for connecting a manipulate-signal electrode, having a screwing portion having a greater diameter than that of the pin portion, the end of the pin portion and the connecting portion being insulated with an insulator;

a base portion having the connecting portion fixed thereto;

three lines disposed in the base portion, connected with the respective three electrodes at one end of the base portion in the base portion, and extending outside the base portion from the other end of the base portion; and a single line disposed in the base portion, connected to the connecting portion at one end of the base portion, and extending outside the base portion from the other end of the base portion.

4. The switch-equipped input-output plug according to claim 1 or 3, wherein the voice-input electrode and the voice-output electrode are respectively a microphone electrode and an earphone electrode.

5. The switch-equipped input-output plug according to claim 1 or 3, wherein the switch-equipped input-output plug is a 3-electrode/4-electrode shared plug.

* * * * *